United States Patent [19]

Boulter

[11] Patent Number: 5,025,746

[45] Date of Patent: Jun. 25, 1991

[54] SEA ANCHOR ASSEMBLY FOR KAYAK

[76] Inventor: Alan J. W. Boulter, 21 Dartmouth Cr., Toronto, Ontario, Canada, M8V 1W9

[21] Appl. No.: 484,262

[22] Filed: Feb. 26, 1990

[30] Foreign Application Priority Data

Mar. 16, 1989 [CA] Canada ..... 593909

[51] Int. Cl.[5] ..... B63B 21/48

[52] U.S. Cl. ..... 114/311; 114/347

[58] Field of Search ..... 114/311, 294, 297, 104, 114/105, 347; 244/113, 147; 150/154

[56] References Cited

U.S. PATENT DOCUMENTS

| | | | |
|---|---|---|---|
| 2,363,732 | 11/1944 | Jenkins | 244/113 |
| 2,536,681 | 1/1951 | Frieder et al. | 114/209 |
| 2,761,636 | 9/1956 | Finlay | 244/113 |
| 2,765,132 | 10/1956 | Oakley | 244/142 |
| 2,785,646 | 3/1957 | Meyer | 114/209 |
| 3,222,014 | 12/1965 | Bowden et al. | 244/113 |
| 3,310,018 | 3/1967 | Roberts, Jr. et al. | 114/104 |
| 3,417,725 | 12/1968 | Fisher | 114/209 |
| 3,842,778 | 10/1974 | Shibata et al. | 114/209 |
| 3,973,236 | 8/1976 | McLaughlin | 114/209 |
| 4,102,289 | 7/1978 | Ebbeson et al. | 114/104 |
| 4,330,895 | 5/1982 | Putman et al. | 114/311 |
| 4,653,219 | 3/1987 | Kaupert | 114/311 |

*Primary Examiner*—Sherman Basinger

*Attorney, Agent, or Firm*—Riches, McKenzie & Herbert

[57] ABSTRACT

A sea anchor assembly for a kayak having two ends and one or more occupant seats, the assembly comprising: an anchor assembly comprising joined end-to-end in succession, an anchoring rope, a collapsible sea anchor, a deployment rope and a float, a ring secured near one end of the kayak, a cleat to releasably secure the anchor rope and the deployment rope proximate the seat, a tubular cover to removably retain the sea anchor therein in a collapsed condition, the cover secured to the kayak between the ring and the rope securing cleat, the anchor assembly extending from an end of the anchoring rope at the rope anchoring through the tubular cover and then through the ring to the float, wherein, with the collapsed sea anchor in the cover, on pulling the deployment rope, the deployment rope on passing through the ring draws the sea anchor out from the cover then through the ring for deployment in water, and wherein, with the sea anchor deployed, pulling the anchoring rope draws the sea anchor through the ring and into the cover with the sea anchor being collapsed on being draw through the ring.

18 Claims, 6 Drawing Sheets

SEA ANCHOR ASSEMBLY FOR KAYAK

STATEMENT OF INVENTION

This invention relates to sea anchors and more particularly, to sea anchors for use on kayaks.

BACKGROUND OF THE INVENTION

Sea anchors are well-known. Sea anchors are useful in holding the bow of a vessel head-up into the wind. In addition, sea anchors are useful for retarding the rate of drift of vessels under wind pressure and for increasing the rate of drift in water currents.

A typical collapsible sea anchor is explemified by Frieder U.S. Pat. No. 2,536,681 teaching, in effect, the collapsible parachute-like device having a flexible fabric canopy joined by a plurality of shroud lines to an anchoring line which is to be tied to a vessel. Other known sea anchors comprise frusto-conical devices which are dragged through the water with their larger end first so as to provide a funnelling effect and thereby drag on the vessel.

Kayaks are known light-weight, single to multiple man, typically double-ended vessels having occupant seats near their middle. Sea anchors may advantageously be used under many circumstances in kayaks, particularly, in kayaks used on the open sea. It is, however, extremely difficult to deploy or retract a sea anchor from a kayak. Even expert kayakers experience difficulties and it is not uncommon for the deployment or retraction of a sea anchor by inexperienced kayakers to result in the capsize of the kayak.

SUMMARY OF THE INVENTION

Accordingly, to at least partially overcome this disadvantage, the present invention provides an assembly which facilitates the deployment and storage of a collapsible sea anchor, and particularly, for the deployment and storage of a collapsible sea anchor from a kayak.

Another object of the present invention is to provide a novel method of mounting a sea anchor on a kayak.

Another object of the present invention is to provide, in combination, an assembly for deployment and storage of a collapsible sea anchor together with a compatible sea anchor assembly.

Another object is to provide an improved kayak including a sea anchor and an assembly for deployment and storage of a collapsible sea anchor from the kayak.

Accordingly, in one of its aspects, the present invention provides an assembly for deployment and storage of a collapsible sea anchor comprising:

elongate strap means having fastening means at each end, ring means secured to the strap means near a first end of the strap means, elongate tubular cover means open at both ends thereof and secured to the strap means to lie along the length of the strap means with a smaller of the open ends near a second end of the strap means and a larger of the open ends between the smaller end of the cover means and the first end of the strap means.

In another aspect, the present invention provides a sea anchor assembly for a kayak having two ends and an occupant seat, said assembly comprising:

an anchor assembly comprising joined end-to-end in succession, anchoring rope means, collapsible sea anchor means, deployment rope means and float means, ring means secured near one end of the kayak, means to releasably secure the anchor rope means and the deployment rope means proximate the seat means, tubular cover means to removably retain the sea anchor means therein in a collapsed condition, the cover means secured to the kayak between the ring means and the rope securing means, the anchor assembly extending from an end of the anchoring rope means at the rope anchoring means through the tubular cover means and then through the ring means to the float means, wherein, with the collapsed sea anchor means in the cover means, on pulling the deployment rope means, the deployment rope means on passing through the ring means draws the sea anchor means out from the cover means then through the ring means for deployment in water, and wherein, with the sea anchor means deployed, pulling the anchoring rope means draws the sea anchor means through the ring means and into the cover means.

BRIEF DESCRIPTION OF THE DRAWINGS

Further objects and advantages of the present invention will appear from the following description taken together with the accompanying drawings in which.

DETAILED DESCRIPTION OF THE DRAWINGS

Figure 2:
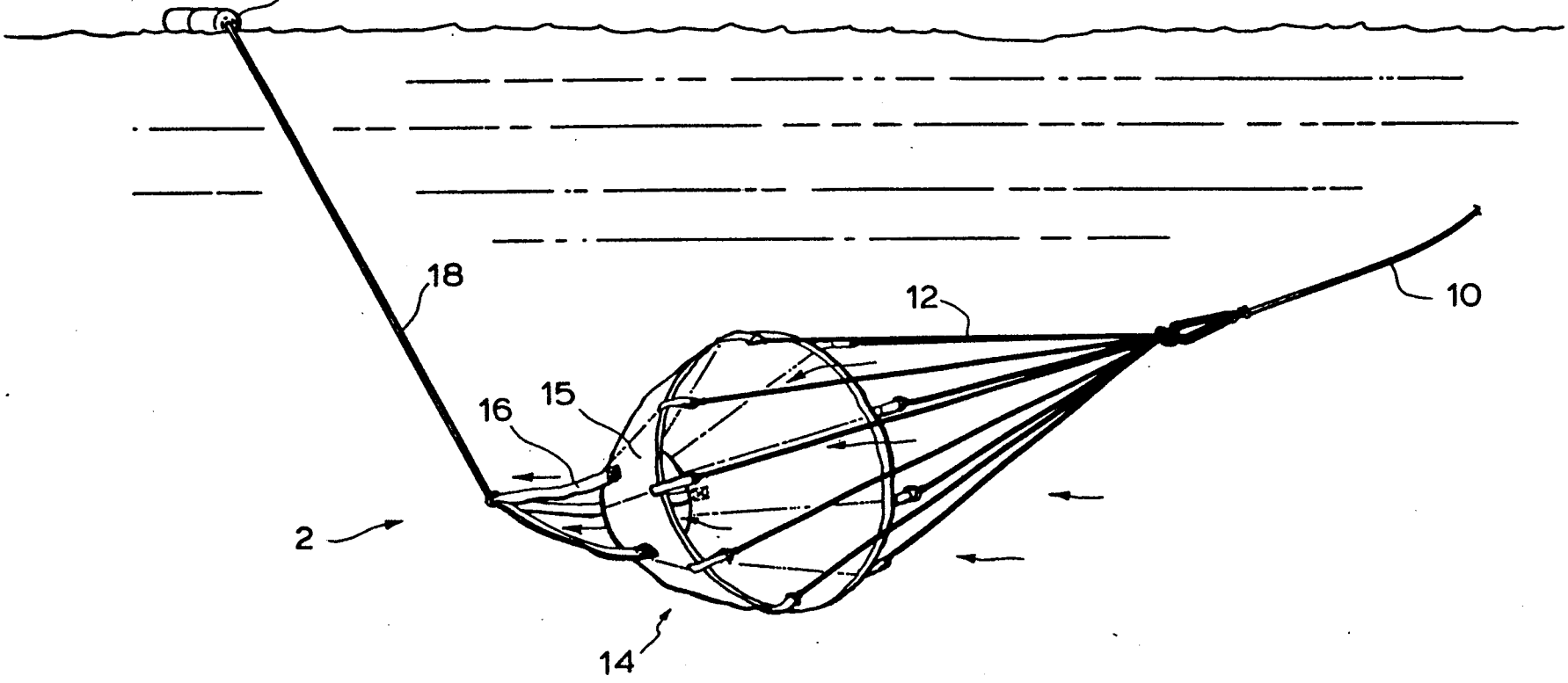
FIG. 2 is a schematic view of the sea anchor assembly from FIG. 1 in use.
Figure 4:
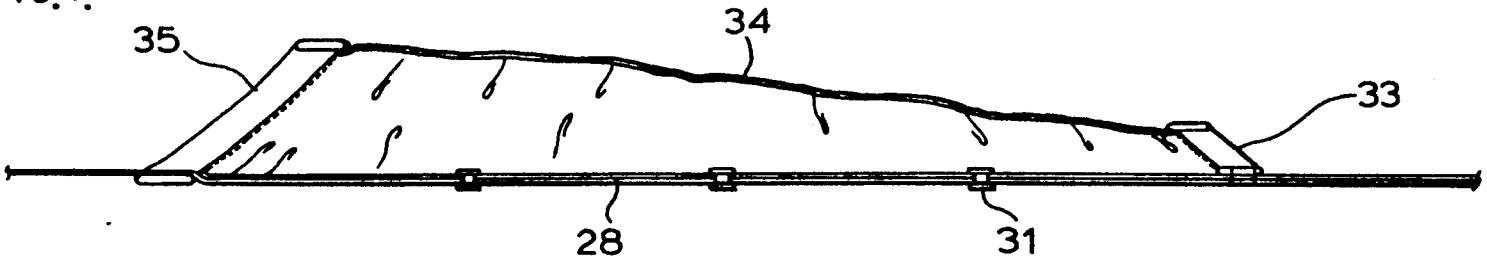
FIG. 4 is a longitudinal cross-sectional view of the cover of the assembly for deployment and storage shown in FIG. 3.

Reference is made first to FIG. 2 showing a sea anchor assembly, generally indicated 2, in accordance with the present invention. Assembly 2 includes anchoring rope 10, a sea anchor generally indicated 14, a deployment rope 18 and a float 20. The sea anchor 14 includes anchoring shroud lines 12, a collapsible, water funnel 15 and deployment shrouds 16. The elements of the assembly 2 are joined together end-to-end in succession. One end of anchoring rope 10 is attached to the gathered ends of the anchoring shroud lines 12: The other end of the anchoring shroud lines 12 are attached at spaced locations about the periphery of the larger end of the funnel 15. The deployment shroud lines 16 are attached at spaced locations about the periphery of the smaller open end of the funnel 15. These deployment shrouds are gathered together and coupled to one end of the deployment rope 18. Float 20 is secured to the other end of deployment rope 18.

In use, with the anchoring rope 10 attached to the kayak, funnel 15 on being drawn through the water, provides resistance so it slows the drift of the kayak. The sea anchor 14 typically becomes submerged below the surface of the water while float 20 has sufficient floatage to remain at the surface at substantially all times.

Figure 3:
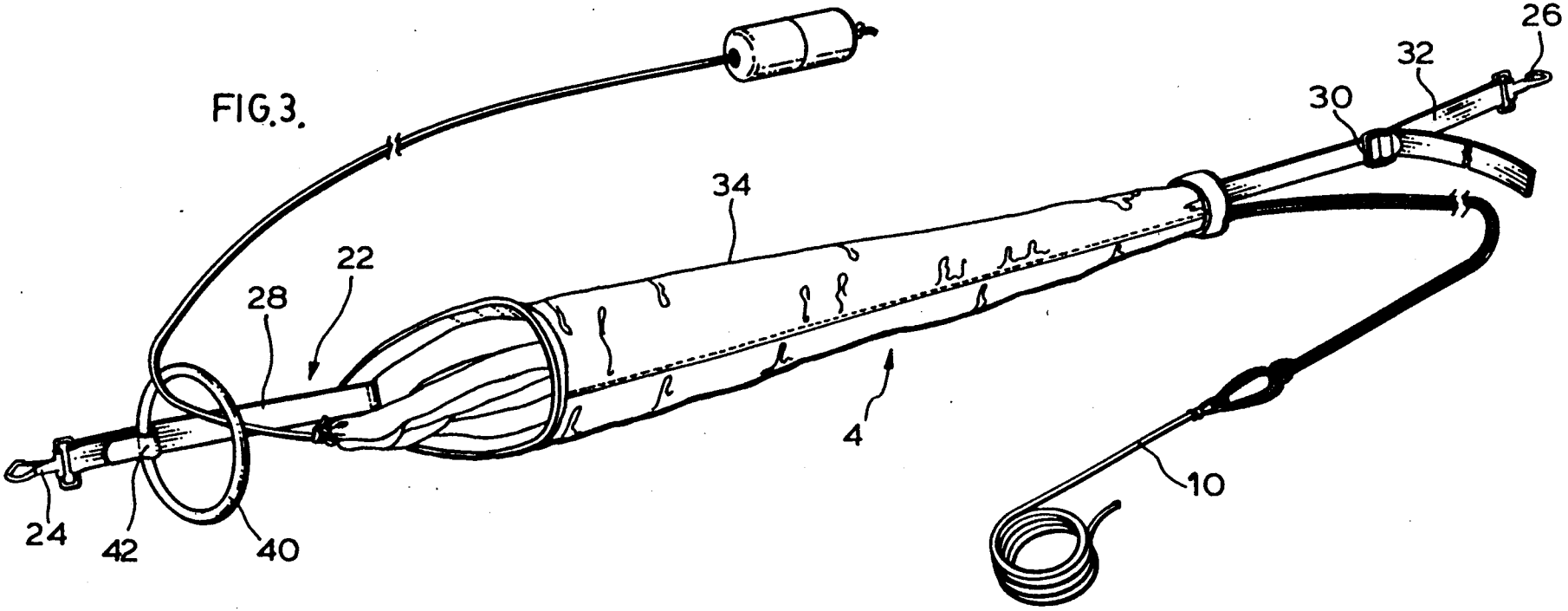
FIG. 3 is an enlarged schematic view of the assembly for deployment and storage from FIG. 1 and showing the sea anchor assembly received therein in a stored configuration.

FIG. 3 shows a deployment and storage assembly generally indicated as 4. Assembly 4 comprises an elongate flexible strap generally indicated 22. The strap has two spring-hook fasteners 24 and 26 at each of its ends. Strap 22 is actually shown as comprising two segments, a first segment 28 which extends from hook fastener 24 to a fixed buckle 30 and a second segment 32 which extends from hook fastener 26 to the buckle and then through the buckle. The length of the strap 22 between hooks 24 and 26 can be adjusted by adjusting the position of the buckle on belt segment 32.

A cover 34 for the sea anchor is secured to strap segment 28. The cover 34 preferably has a marginally tapering, frusto-conical configuration with a smaller open end 33 near buckle 30 and larger open end 35 directed towards fastener 24 preferably spaced therefrom. Cover 34 may advantageously be fastened along its length as by being sewn to strap segment 28. Preferably, reinforcing grommets 31 may also be provided. Cover 34 is sized to be complimentary to the collapsible water funnel 15 so that the water funnel may be drawn into cover 34 and retained securely therein.

Ring member 40 is secured to the strap 22 near hook 24 as by being affixed to a short flexible loop of the strap serving as a tether 42.

Figure 1:
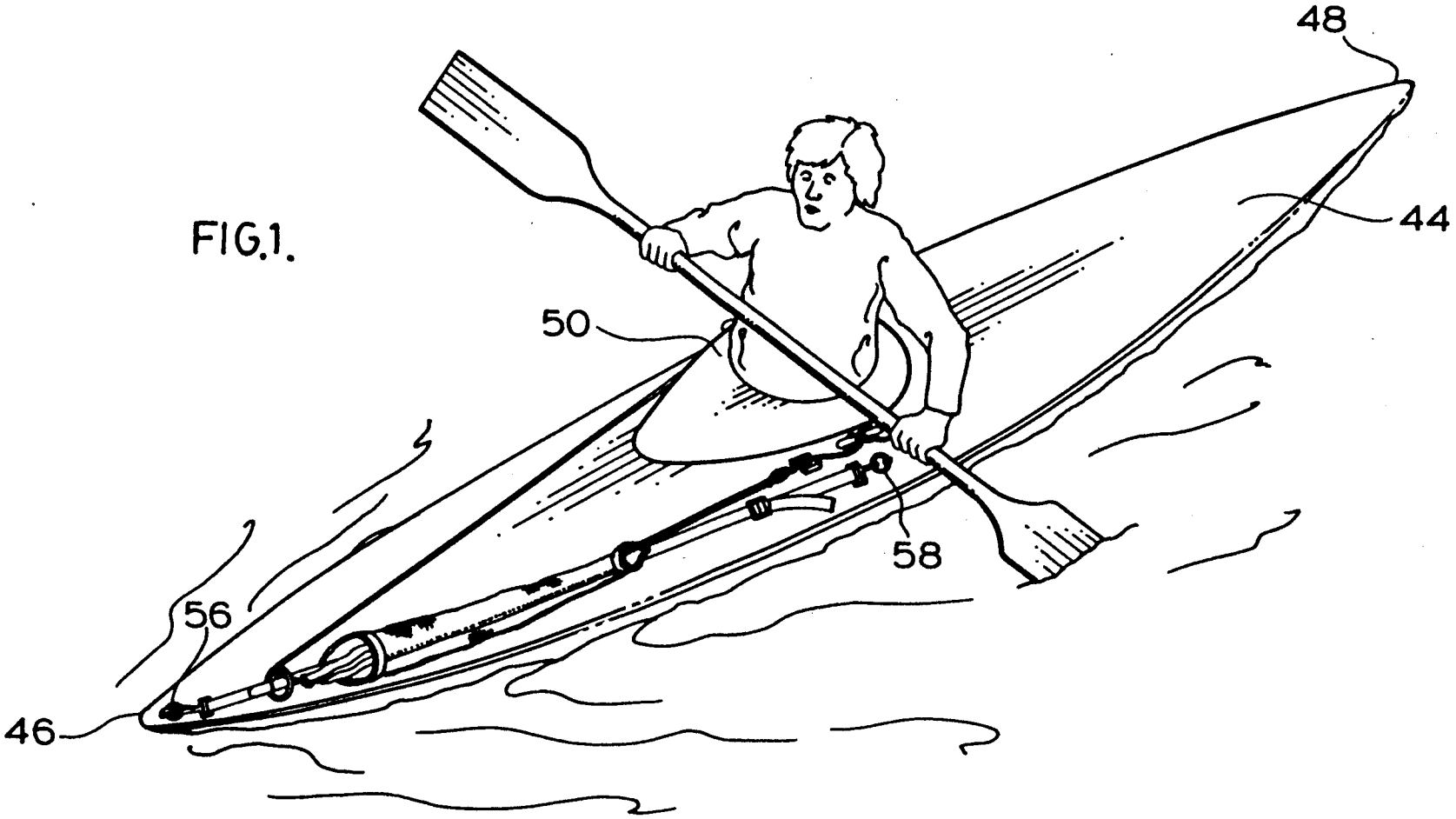
FIG. 1 is a pictorial view of a kayak fitted with a sea anchor assembly and an assembly for deployment and storage in accordance with the present invention and showing the sea anchor assembly in a stored configuration.
Figure 5:
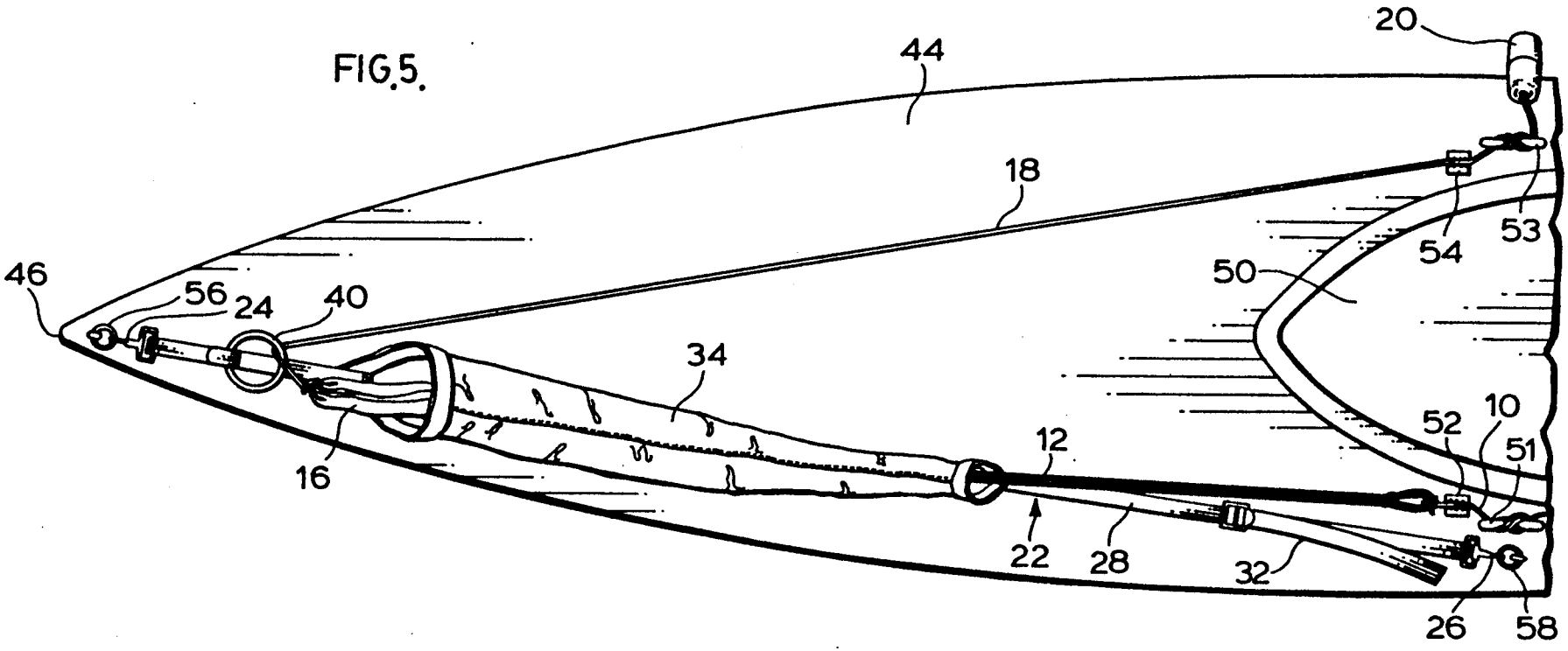
FIG. 5 is an enlarged pictorial top view of the forward half of kayak of FIG. 1 with a sea anchor in a stored configuration.

Reference is now made to FIGS. 1 and 5 which show a typical kayak 44 having a bow end 46 and a stern end 48 and with an occupant seat 50 located centrally therebetween. The kayak has near the seat 50 cleats 51, 52, 53 and 54, such as conventional bracket cleats 51 and 53 and jam cleats 52 and 54. Two ring eyelets 56 and 58 are provided, one near bow end 46 and the other near seat 50.

The deployment and storage assembly 4 is secured to the kayak 44 in the preferred embodiment shown with hook 24 engaging eyelet 56 and hook 26 engaging eyelet 58. When so engaged, the free end of strap segment 32 may be pulled so as to tension strap 22 between eyelets 56 and 58.

The sea anchor assembly 2 is received in the deployment and storage assembly 4 by passing anchoring rope 10 through ring 40 and then longitudinally through cover 34 with the anchoring rope 10 to be secured to anchoring cleats 51 and 52 at various positions along the anchoring rope 10 as may be desired.

In a stored position, as shown in FIG. 5, the anchor assembly 2 is arranged so that the water funnel 15 is received within cover 34; with the anchoring rope 10 cleated to anchoring cleats 51 and 52, and with excess anchoring rope placed within the seat space of the kayak or otherwise coiled. In this configuration, both the anchoring shroud lines 12 and the deployment shroud lines 16 will be collapsed and the deployment rope 18 will extend up through the ring 14 and then rearward from the bow end 46 of the kayak to where the deployment rope 18 and float 20 are secured by the deployment cleats 53 and 54.

Figure 6:
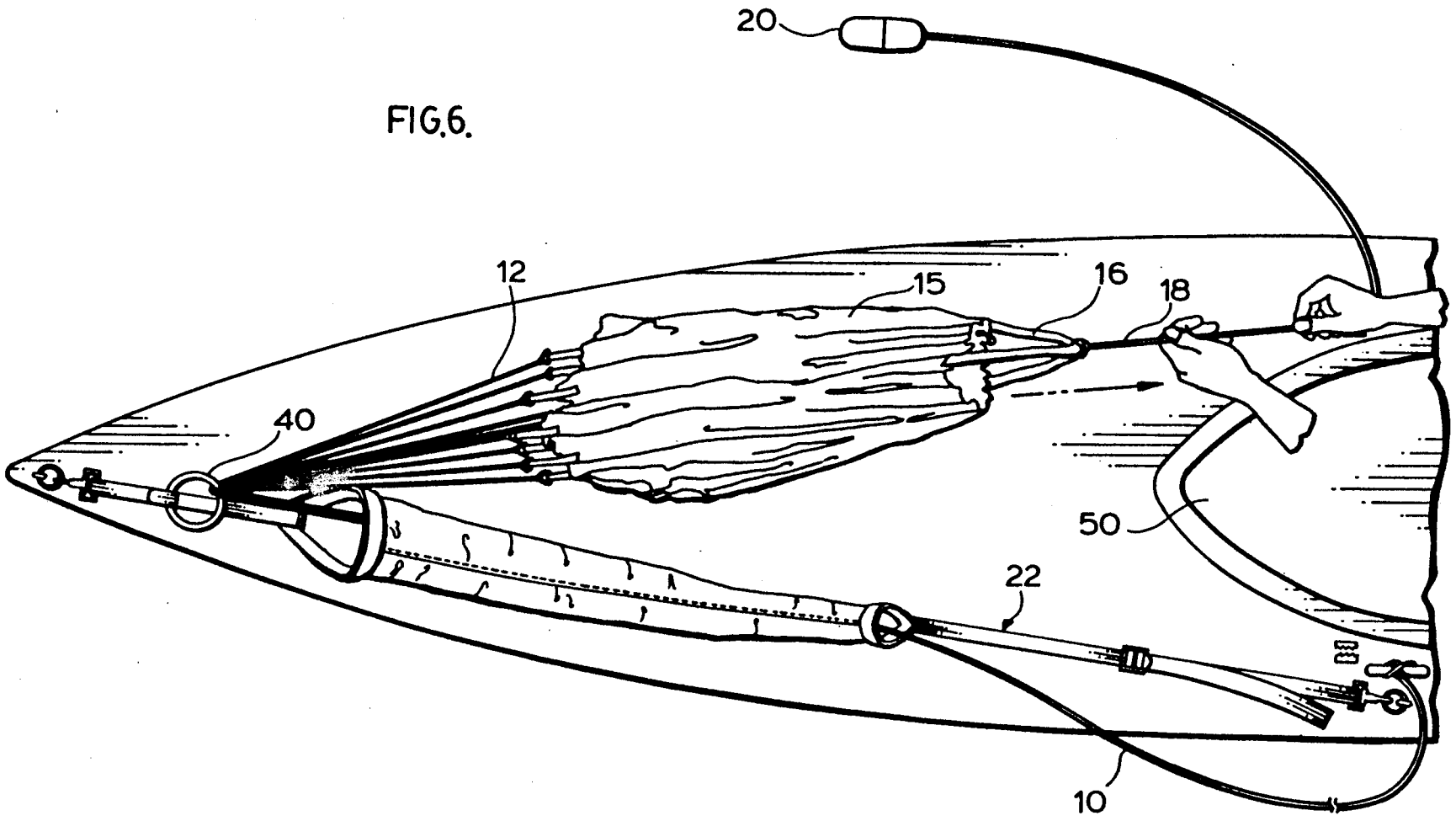
FIG. 6 is a view similar to FIG. 5 but schematically showing a kayak occupant deploying the sea anchor from the stored configuration.

FIG. 6 schematically shows the kayak occupant deploying the sea anchor assembly from a stored position for use. To deploy the sea anchor assembly, the kayak occupant uncleats the anchoring rope 10 to provide sufficient slack. Next, the deployment rope 18 and float 20 are disengaged from cleat 54 and the deployment rope drawn by the occupant. On drawing the deployment rope 18, the ring 40 serves like a pulley so that the rearward drawing of the rope 18 by the occupant will draw the sea anchor 14 forwardly towards ring 40, out of cover 34 and subsequently through ring 40.

Providing ring 40 is advantageous in that, if in a similar system the ring is not provided, rearward drawing of the deployment rope 18 by the occupant would result in the end 35 of the cover 34 collapsing and pinching upon the deployment rope 18 preventing withdrawal of the sea anchor 14. At this point, the occupant can place or throw the float 20 into the water which the sea anchor 14 will follow. Subsequently, additional anchoring rope 10 may be let out as desired and due to the drifting of the kayak or otherwise paddling, the sea anchor will become engaged to retard drifting of the kayak. As the anchoring rope passes through ring 40 to the anchor, the sea anchor will serve to keep the kayak pointing with its bow end 46 directed into the wind and presumably the waves. The configuration of the sea anchor in use is shown in FIG. 2.

Figure 7:
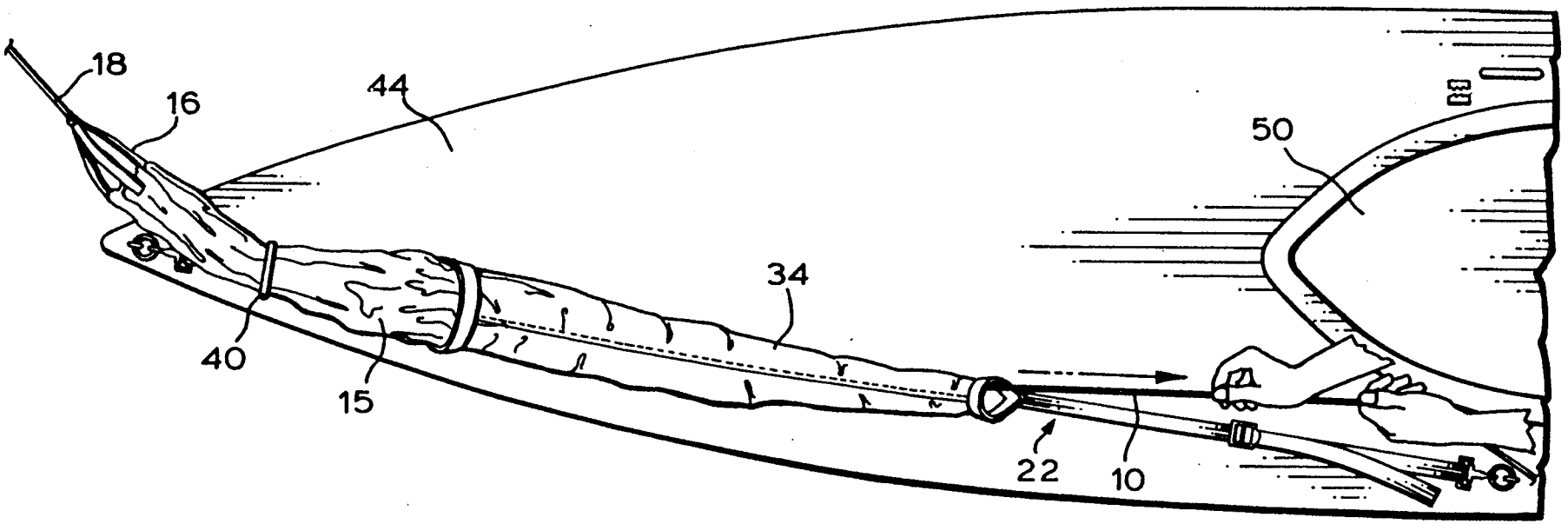
FIG. 7 is a view similar to FIGS. 5 and 6 but showing retrieval of the sea anchor assembly after use of the sea anchor.

FIG. 7 schematically shows the kayak occupant in final stages of retracting and collapsing the sea anchor. To retract the sea anchor, the occupant draws on anchoring rope 10. The anchoring rope 10 pulls the anchoring shroud lines 12 in through ring 40. Ring 40 is preferably chosen to be of a size so as to serve to collapse the anchoring shroud lines 12 and thereby subsequently collapse the water funnel 15 on drawing of the anchoring rope 10. The anchoring rope 10 is continued to be pulled by the occupant until the water funnel 15 is drawn up into and securely received within cover 34. At that point, the kayak occupant paddles the kayak so as to manually pick up float 20 and secure the deployment rope 18 and float 20 to the cleats 53 and 54 to assume the stored position as shown in FIG. 5.

As to materials of construction, the strap segments 22 and 24 may preferably comprise a flexible nylon ribbon-like strap of substantial strength. Cover 34 and the water funnel may preferably comprise collapsible fabric material such as nylon sheeting sewn into the desired shapes and suitably reinforced.

Ring 40 may comprise a thin toroidal hoop, for example, of relatively rigid plastic or somewhat flexible elastomeric material. The ring 40 should have sufficient rigidity to substantially retain its shape as is advantageous to protect the ring from being deformed to collapse or pinch shut on the deployment rope 18 on the sea anchor when drawing the deployment rope 18 during deployment as seen in FIG. 6.

Ring 40 is shown secured by tether 42 so as to permit free pivoting or articulation in most directions. The ring could also be mounted so as to be fixed relative to the kayak. This can be advantageous in the ring acting like a pulley on deployment. While it is preferred that the ring be circular, it is to be appreciated that many other shapes such as triangular, square, polygonal and the like would prove satisfactory. The ring preferably has a central opening which is suitably sized to collapse the sea anchor and in this regard preferred practical sizes have been found to be in the range of two to six inches and, more preferably, greater than about three inches.

While not necessary, float 20 may be provided to be of a size which does not pass through ring 40.

In the illustrated preferred embodiment, the sea anchor 14 has been shown to comprise a somewhat frusto-conical collapsible water funnel. Other known shapes of sea anchors may readily be used such as parachute-like canopies which are similar in most respects to the water funnel. With such devices, the deployment shroud lines 16 may not be necessary and the deployment rope 18 could be joined at almost anywhere on their downstream side. The particular nature of the sea anchor 14 is not critical other than its ability to be collapsible and being capable of being stored in a suitable cover 34.

Cover 34 has been shown to be of a frusto-conical tapered, hollow tubular construction with two open ends. The smaller end of the cover preferably is sized to prevent the passage of the sea anchor therethrough on retrieval. This also assists in locating the sea anchor securely within the cover. While this is preferred, it is clear that nontapered covers and those having cross-sections which may not be circular would readily serve the purpose of storage and retention of the sea anchor 14 in a collapsed state.

The preferred embodiment shows four cleats 51, 52, 53 and 54. It is appreciated that such cleats may not, strictly speaking, be necessary or that a single cleat may be provided which could serve the purpose of securing both the anchoring rope 10 and the deployment rope 18. Other means could, of course, be provided for anchoring the float 20. The length of the deployment rope 18 is not critical, however, it may be advantageous to have this rope of a suitable length relative to the kayak so that when the sea anchor is drawn into cover 34, the float 20 will extend rearward from ring 40 to about the location of the cleat 54.

In the preferred embodiment, the strap 22 has been shown to be a flexible strap, is to be appreciated that strap 22 could be replaced by many other securement means including a rigid rod.

The preferred embodiment of the invention shows the particular deployment and storage assembly with its hooks 24 and 26 so that the combination of the deployment and storage assembly and the sea anchor assembly may readily be coupled to and coupled from a kayak 44 as, for example, for removal on calm days when a sea anchor may not be necessary. The invention of the present application is, however, adaptable for permanent coupling to a kayak 44 as, for example, by securing ring 40 directly to the bow end 46 of the kayak and securing cover 34 directly to the kayak itself, as, for example, eliminating the need for strap 22 and its fastening hooks. Ring 40 may be secured directly to the bow end to either be pivotable to assume different positions or fixed against movement.

While the invention of the present application and particularly the deployment and storage assembly are particularly adapted for use in a kayak in which the occupant is restrained within a seat 50, is to be appreciated that the deployment and storage assembly may have substantial advantage when used, for example, on other vessels to serve as a convenient assembly for storage of the sea anchor assembly and for ensuring that the sea anchor assembly may remain in position ready to be deployed should the need arise.

While the invention has been described with reference to a preferred embodiment, the invention is not so limited. Many variations and modifications will now occur to persons skilled in the art. For definition of the invention, reference is made to the appended claims.

What I claim is:

1. An assembly for deployment and storage of a collapsible sea anchor comprising:

(a) elongate strap means having fastening means at each end;

(b) ring means secured to the strap means near a first end of the strap means;

(c) elongate tubular cover means open at both ends thereof and secured to the strap means to lie along the length of the strap means with a first of the open ends near a second end of the strap means and a second of the open ends between the first end of the cover means and the first end of the strap means; and (d) a sea anchor assembly comprising joined end-to-end in sequence: anchoring rope means; collapsible sea anchor means; deployment rope means; and float means, the sea anchor assembly extending longitudinally through the cover means and through the ring means, in a storage configuration, the sea anchor means disposed within the cover means with the anchoring rope means extending out said first open end of the cover means and the deployment rope means extending out said second open end of the cover means and then through the ring means to the float, the sea anchor means deployable from the cover means and through the ring means by drawing the deployment rope means, the sea anchor means retractable from an expanded open position in use, by drawing the anchor rope means to draw the sea anchor means through the ring means and into the cover.

2. An assembly as claimed in claim 1 wherein said strap means includes means for adjusting the length of the strap means between the fastening means.

3. An assembly as claimed in claim 2 wherein said first open end of the cover means is smaller than the second open end of the cover means, the cover means reducing in cross-sectional size between the second larger end and the first smaller end.

4. An assembly as claimed in claim 3 wherein said cover means is generally frusto-conical in shape and comprises flexible collapsible material.

5. An assembly as claimed in claim 4 wherein said fastening means are manually releasable and engageable.

6. An assembly as claimed in claim 1 wherein said ring means comprises a rigid hoop.

7. An assembly as claimed in claim 6 wherein said ring means is secured to said strap means for articulate movement relative to the strap means.

8. An assembly as claimed in claim 7 wherein said ring means has a central opening therethrough of at least three inches in diameter.

9. An assembly as claimed in claim 1 wherein said sea anchor means comprises:

flexible water funnelling means having a plurality of anchoring shroud means secured about its periphery at a larger end thereof, the anchoring shroud means secured together to the anchoring rope means, and the deployment rope means secured to the water funnelling means at a smaller end thereof.

10. An assembly as claimed in claim 9 wherein said sea anchor means further include a plurality of deployment shroud means secured about the periphery of the water funnelling means at the smaller end thereof, the deployment shroud means secured together to the deployment rope means.

11. An assembly as claimed in claim 10 wherein said ring means is sized relative to the anchoring shroud means to urge the anchoring shroud means together on the anchoring shroud means being drawn by the anchoring rope means through the ring means to collapse the water funnelling means.

12. An assembly as claimed in claim 1 further comprising a kayak having two ends and occupant seat means, said strap means secured to the kayak by said fastening means with said first end of the strap means near one end of the kayak and said second end of the strap means secured proximate said occupant seat, means for releasably securing said anchor rope means and said deployment rope means proximate said occupant seat means.

13. An assembly as claimed in claim 12 wherein said strap means is tensioned between the two said fastening means to provide said cover means and ring means in alignment to facilitate the deployment and retraction of the sea anchor means.

14. An assembly as claimed in claim 13 wherein said sea anchor means comprises:

flexible water funnelling means having a plurality of anchoring shroud means secured about its periphery at a larger end thereof, the anchoring shroud means secured together to the anchoring rope means, and the deployment rope means secured to the water funnelling means at a smaller end thereof.

15. An assembly as claimed in claim 14 wherein said sea anchor means further include a plurality of deployment shroud means secured about the periphery of the water funnelling means at the smaller end thereof, the deployment shroud means secured together to the deployment rope means.

16. An assembly as claimed in claim 15 wherein said ring means is sized relative to the anchoring shroud means to urge the anchoring shroud means together on the anchoring shroud means being drawn by the anchoring rope means through the ring means to collapse the water funnelling means.

17. An assembly as claimed in claim 16 wherein said ring means is secured to said strap means for articulate movement relative to the strap means.

18. A sea anchor assembly for a kayak having two ends and an occupant seat, said assembly comprising:

an anchor assembly comprising joined end-to-end in succession, anchoring rope means, collapsible sea anchor means, deployment rope means and float means, ring means secured near one end of the kayak, means to releasably secure the anchor rope means and the deployment rope means proximate the seat means, tubular cover means to removably retain the sea anchor means therein in a collapsed condition, the cover means secured to the kayak between the ring means and the rope securing means, the anchor assembly extending from an end of the anchoring rope means at the rope anchoring means through the tubular cover means and then through the ring means to the float means, wherein, with the collapsed sea anchor means in the cover means, on pulling the deployment rope means, the deployment rope means on passing through the ring means draws the sea anchor means out from the cover means then through the ring means for deployment in water, and wherein, with the sea anchor means deployed, pulling the anchoring rope means draws the sea anchor means through the ring means and into the cover means.

* * * * *